US006679748B2

(12) United States Patent
Forti et al.

(10) Patent No.: US 6,679,748 B2
(45) Date of Patent: Jan. 20, 2004

(54) FLYING TUBE TOY

(76) Inventors: William Mark Forti, 112 N. Harvard, #229, Claremont, CA (US) 91711; William B. Forti, 112 N. Harvard, #229, Claremont, CA (US) 91711

( * ) Notice: Subject to any disclaimer, the term of this patent is extended or adjusted under 35 U.S.C. 154(b) by 0 days.

(21) Appl. No.: 10/340,343

(22) Filed: Jan. 9, 2003

(65) Prior Publication Data

US 2003/0162469 A1 Aug. 28, 2003

Related U.S. Application Data

(60) Provisional application No. 60/348,024, filed on Jan. 10, 2002.

(51) Int. Cl.[7] ..... A63H 27/00
(52) U.S. Cl. ..... 446/34; 446/61
(58) Field of Search ..... 446/61, 46, 34; 116/264, 265, 173; 244/153 R, 153 A; 40/214, 215, 477; 473/588, 589

(56) References Cited

U.S. PATENT DOCUMENTS 1,401,626 A * 12/1921 Mader ..... 116/173
1,579,034 A * 3/1926 Roberts ..... 73/170.05
4,246,721 A * 1/1981 Bowers ..... 446/61
4,624,648 A * 11/1986 Waters ..... 446/176
4,669,304 A * 6/1987 Caragata ..... 73/170.07
5,365,685 A * 11/1994 Shank ..... 40/212
5,810,637 A * 9/1998 Mileti ..... 446/61
5,833,174 A * 11/1998 Knight et al. ..... 244/155 A
6,083,128 A * 7/2000 Young et al. ..... 473/576
6,135,388 A * 10/2000 Hostetter ..... 244/153 R
6,390,879 B1 * 5/2002 Spector ..... 446/46
6,520,825 B1 * 2/2003 Herr ..... 446/71

* cited by examiner

*Primary Examiner*—Jacob K. Ackun
*Assistant Examiner*—Faye Francis
(74) *Attorney, Agent, or Firm*—Rutan & Tucker, LLP; Robert D. Fish

(57) ABSTRACT

A flying toy has a leader portion defining an opening, and a supple tail portion defining an inlet and outlet, wherein when the toy is flying in air, the air enters through the inlet and exits through the outlet. Also, a center of gravity of the toy is within the leader portion. Furthermore, the thickness of the tail portion is not more than 1 mm, or even 0.5 mm.

9 Claims, 1 Drawing Sheet

FLYING TUBE TOY

This application claims the benefit of U.S. provisional application No. 60/348,024, filed Jan. 10, 2002, incorporated herein by reference in its entirety.

FIELD OF THE INVENTION

The field of the invention is flying toys.

BACKGROUND OF THE INVENTION

There are many types of flying toys, including mechanically powered flying toys (such as those using rubber bands, motors, and pressurized gas or water for propulsion) and hand-launched toys having no on-board propulsion system. Within the latter category are substantially hollow, tubular shapes, through which air can pass as the toy is flying through the air. Some of those toys are described below.

U.S. Pat. No. 5,067,922 issued to M. E. McMahon (Nov. 26, 1991) teaches an insulating device for keeping a container of liquid from losing its thermal content to its environment that can double as a recreational throwing toy. The device is constructed of an insulating material, which is adhered to the inner side of the outer cylinder of a stiff, yet flexible plastic composite that provides aerodynamic stability and durability.

U.S. Pat. No. 4,246,721 issued to L. Bowers (Jan. 27, 1981) teaches an aerial toy comprising a substantially annular hollow body having a thin wall intermediate portion including a leading and trailing edge, and an annular recess formed on the outer surface of the thin wall intermediate portion immediately adjacent the leading edge.

U.S. Pat. No. 4,790,788 issued to J. M. Hill (Dec. 13, 1988) teaches an aerial toy comprising a body having a leading edge and a trailing edge, and comprising a flexible resilient thin wall sail or airfoil extending forward from the trailing edge. The toy has a ratio of body length to body diameter of between 1:1.25 and 1:1.35.

U.S. Pat. No. 4,850,923 issued to R. D. Etheridge (Jul. 25, 1989) teaches a flying toy with a hollow cylinder having an annular side wall with a leading end and a trailing end and an inner and outer surface is formed so that the outer surface of the side wall at the leading end of the cylinder has an airfoil shape, so that a lift is generated on the outer surface of the side wall of the cylinder as the cylinder travels through the air.

U.S. Pat. No. 3,264,776 issued to W. B. Morrow (Aug. 9, 1966) teaches tubular flying toys exhibiting airfoil characteristics. The toy has a weighted area at the leading end, and is made from polyvinyl chloride, high and low density polyethylene, styrene, wood aluminum and many other materials that are stiff and rigid and have a specific gravity of approximately 0.9 or greater.

U.S. Pat. No. 2,683,603 issued to P. H. Gackenbach teaches a projectile with a generally hollow cylindrical or tubular construction with a peculiarly warped and eccentric construction and erratic eccentric weight distribution, which is designed to give it its erratic flight.

U.S. Pat. No. 3,600,842 issued to H. Bryman (Aug. 24, 1971) teaches a glider toy that is formed of a light plastic hollow cylindrical body, the leading edge of which is circular and lies in a plane normal to the cylindrical axis. The leading edge is reinforced with a plastic band, while the trailing edge of the body is angularly disposed with respect to the cylindrical axis. The body is preferably made from polystyrene.

Despite the considerable diversity in tube-shaped flying toys, they are all similar in having tail portions with thicknesses that are at least 5 mm or more. One result is that the tail portions of those toys are stiff and/or not easily crushable, which surprisingly makes the toys difficult to throw. Thus, there is a need to provide tube-shaped flying toys having very thin tail portions.

SUMMARY OF THE INVENTION

The present invention is a tube-shaped flying toy having an extremely flexible tail, preferably not more than 1 mm thick. Preferred embodiments have tissue like tail sections, with thicknesses of not more than 0.5 mm.

The toy is designed to be thrown by a person or a launcher and glide through the air before falling to the ground. The toy is contemplated to be lightweight and flexible, bendable, and crushable, especially the tail portion. Various objects, features, aspects and advantages of the present invention will become more apparent from the following detailed description of preferred embodiments of the invention, along with the accompanying drawings in which like numerals represent like components.

DETAILED DESCRIPTION

Figure 1:
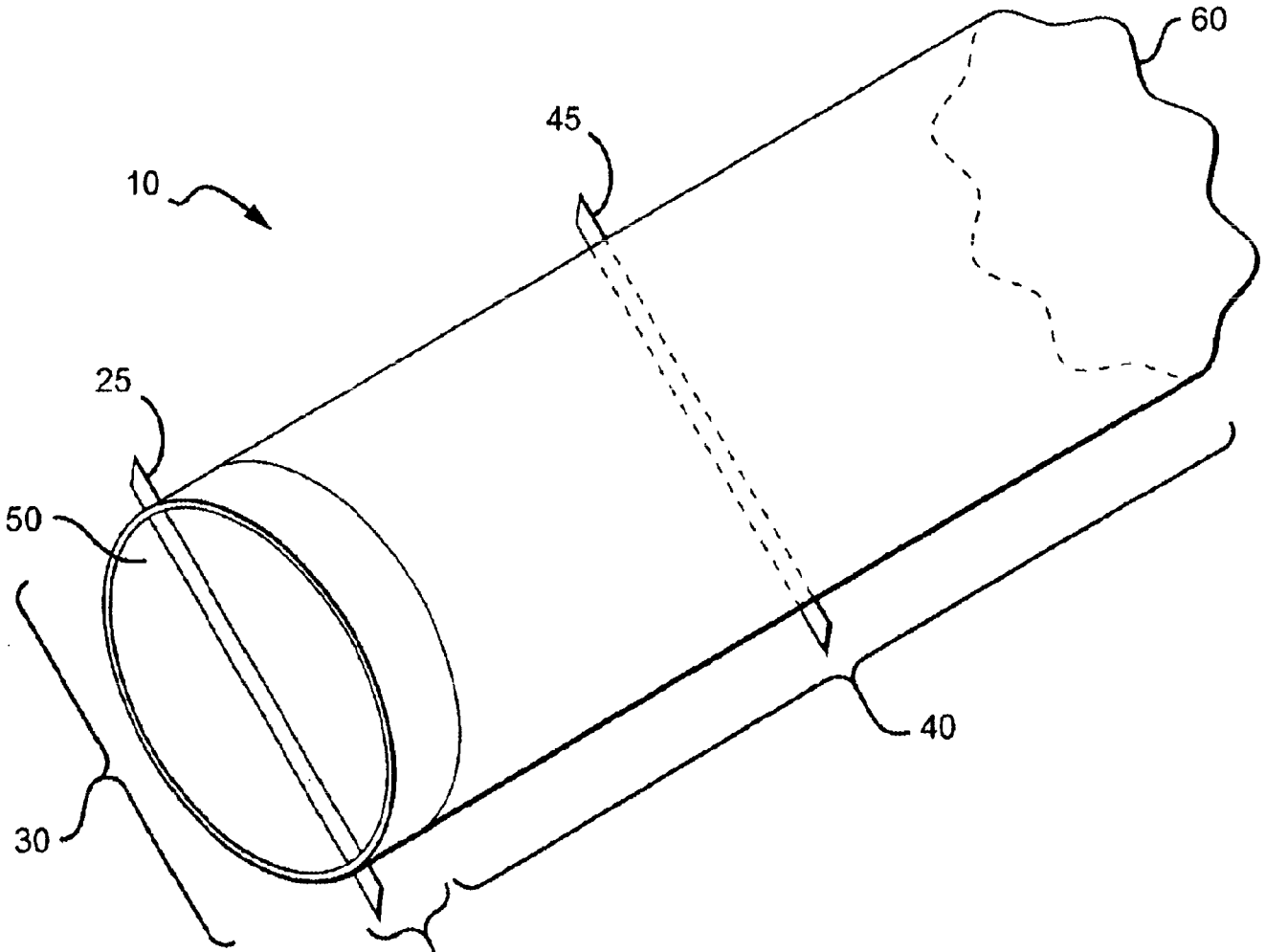
FIG. 1 is a side view of a flying toy.

According to FIG. 1, a flying toy 10 comprises a leader portion 20, with a vertical cross-section 25 that defines an opening 30, and a tail portion 40, with a vertical cross-section 45, that defines an inlet 50 and an outlet 60.

In preferred embodiments, the toy 10 is sized and shaped to fit in the palm of a child's or teen's hand. However, it is also contemplated that the toy 10 may be sized and shaped to fit into the palm of an adult hand, or even larger so that the toy may be launched from a launcher, such as a mechanical launcher.

The leader portion 20 comprises a weighted portion positioned near the opening 30. The leader portion 20 may comprise any material that is durable including fabric, metal, wood, or plastic. It is further contemplated that the leader portion 20 may be metalized. The leader portion 20 need not be flexible or bendable but it is preferred that the leader portion 20 comprises a flexible plastic or a flexible polymer. Using a flexible plastic typically reduces injuries to both users and objects that the toy 10 may collide with when thrown.

Additionally, the vertical cross section 45 of the leader portion 20 is preferably circular, although the vertical cross-section 45 may be any shape including square, oval, rectangle, triangle, and polygon. It is also preferred that the opening 30 has a perimeter ranging between 35 cm and 75 cm, and is preferably at least 50 cm.

The center of gravity is a geometric property of any object, and is used herein to mean the average location of the weight of an object. In contemplated embodiments, the flying toy 10 has a center of gravity within the leader portion 20.

The tail portion 40 may comprise any extremely flexible material that is bendable, crushable, cloth-like, or paper-like. Some examples of an extremely flexible material are a shirt, handkerchief or any other fabric, a paper towel, tissue paper, voile, nylon, and plastic wrap. It is preferable that the extremely flexible material is a fabric, and more preferably, nylon.

The thickness of the tail portion 40 contributes to the toy's ability to fly through the air. It is contemplated that the tail portion 40 has a thickness of not more than 1 mm, or even 0.5 mm, making the tail portion 40 easily flexible, crushable, and bendable. Furthermore, the tail portion 40 may have any length between 8 cm and 25 cm, or longer. In preferred embodiments, the tail portion 40 is at least 10 cm long. It is further preferred that the vertical cross-section 45 of the tail portion 40 comprises any polygonal shape, preferably a circle, and more preferably the same shape as the vertical cross-section 25 of the leader portion 20.

The leader 20 and tail 40 portions of the toy 10 together form a substantially tubular shape. In one preferred embodiment, the leader 20 and tail portions 40 form a substantially cylindrical shape. In other preferred embodiments, they may also form other three-dimensional elongated shapes. It is further contemplated that the leader 20 and tail portions 40 are hollow to allow airflow through them, enabling the toy 10 to fly through the air for longer periods of time.

The contemplated structure of the tube toy 10 allows the toy 10 to glide through the air, rather than following an erratic flight. The leader portion 20 is coupled to the tail portion 40 to form the toy 10. In preferred embodiments, the leader 20 and tail portions 40 are glued together so as to form a secure and tight fit, and to eliminate air pockets as well as extra weight. However, the leader 20 and tail portions 40 may also be sewn, taped, or otherwise coupled together so long as they fit together cohesively. Additionally, the leader 20 and tail portions 40 of the toy 10 may be constructed so that the tail portion 40 overlaps the leader portion 20, or perhaps more preferably, the leader portion 20 may overlap the tail portion 40 so that air flow may pass smoothly and continuously over the leader portion 20 and then the tail portion 40 as the toy 10 flies through the air.

The shapes of the inlet 50 and outlet 60 may comprise any polygonal shape. In a preferred embodiment, the shapes of the inlet 50 and outlet 60 both comprise a circle. However, it is also possible for the inlet 50 to comprise a different shape than the outlet 60. The length of the perimeters (or circumferences if they are circles) of the inlet 50 and the outlet 60 may range between 35 cm and 75 cm. In a preferred embodiment, the length of the perimeters of the inlet 50 and the outlet 60 are similar and are at least 50 cm. In a further preferred embodiment, an area defined by the inlet 50 is unequal to an area defined by the outlet 60.

It is further contemplated that the leader 20 and tail portions 40 of the flying tube toy 10 may be made up of several parts that are coupled together. For example, strips of nylon may be glued, taped, or sewn together to make up the tail portion 40. Similarly, several pieces may be joined together to make up the leader portion 20. It is also contemplated that the leader portion 20 and tail portions 40 of the toy may not be uniform. For example, part of the toy 10 may be made of several different types of material coupled together as long as the overall weighting of the toy 10 allows for smooth flight and the center of gravity remains within the leader portion 20.

In other contemplated embodiments, the toy 10 may be brightly colored and may contain designs. Also, the toy may contain ornamentation, such as beads or appliqués. Other decorations may be added to the toy 10 to increase its attractiveness to target a class of users. The outlet 60 may be fringed, cut, or ornamentalized so as to wave around or flap during flight.

Thus, specific embodiments and applications of flying toys have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A flying toy comprising:

a ring-shaped leader portion defining an opening having a perimeter of between 35 cm and 75 cm, wherein the ring-shaped leader portion is flexible and further comprises a weighted metallized portion such that a center of gravity of the toy is within the leader portion; and an extremely flexible tail portion defining an inlet and outlet, wherein when the toy is flying in air, the air enters through the inlet and exits through the outlet.

2. The toy of claim 1, wherein the leader portion comprises a flexible plastic.

3. The toy of claim 1, wherein the opening is at least 50 cm in perimeter.

4. The toy of claim 1, wherein a vertical cross-section of the tail portion is the same shape as a vertical cross section of the leader portion.

5. The toy of claim 1, wherein the tail portion comprises a fabric.

6. The toy of claim 1, wherein the tail portion has a thickness of not more than 1 mm.

7. The toy of claim 1, wherein the tail portion has a thickness of not more than 0.5 mm.

8. The toy of claim 1, wherein the tail portion is at least 10 cm long.

9. The toy of claim 1, wherein the tail portion overlaps the leader portion.

* * * * *